US009748698B1

(12) United States Patent
Morgan et al.

(10) Patent No.: US 9,748,698 B1
(45) Date of Patent: Aug. 29, 2017

(54) ELECTRICAL CONNECTOR HAVING COMMONED GROUND SHIELDS

(71) Applicant: TYCO ELECTRONICS CORPORATION, Berwyn, PA (US)

(72) Inventors: Chad William Morgan, Carneys Point, NJ (US); Timothy Robert Minnick, Enola, PA (US); Arturo Pachon Munoz, Hummelstown, PA (US); David Wayne Helster, Dauphin, PA (US); Brian Patrick Costello, Scotts Valley, CA (US); Douglas Edward Lawrence, Sinking Spring, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/198,567

(22) Filed: Jun. 30, 2016

(51) Int. Cl.

| | |
|---|---|
| ***H01R 13/648*** | (2006.01) |
| ***H01R 13/6473*** | (2011.01) |
| ***H01R 12/71*** | (2011.01) |
| ***H01R 12/73*** | (2011.01) |
| ***H01R 12/75*** | (2011.01) |
| ***H01R 12/70*** | (2011.01) |
| ***H01R 13/6599*** | (2011.01) |
| ***H01R 13/6587*** | (2011.01) |

(52) U.S. Cl.
CPC ..... *H01R 13/6473* (2013.01); *H01R 12/707* (2013.01); *H01R 12/71* (2013.01); *H01R 12/737* (2013.01); *H01R 12/75* (2013.01); *H01R 13/6587* (2013.01); *H01R 13/6599* (2013.01)

(58) Field of Classification Search
CPC ..... H01R 13/648; H01R 13/6581; H01R 13/6585; H01R 13/6586; H01R 13/6587; H01R 13/6594
USPC ..... 439/607.1, 607.01, 607.5
See application file for complete search history.

(56) References Cited

U.S. PATENT DOCUMENTS

| | | | | |
|---|---|---|---|---|
| 8,382,520 | B2 * | 2/2013 | Ritter | H01R 12/724 439/541.5 |
| 8,905,785 | B2 | 12/2014 | Johnescu et al. | |
| 9,004,943 | B2 * | 4/2015 | Johnescu | H01R 13/65807 439/607.05 |
| 9,017,103 | B2 * | 4/2015 | Davis | H01R 23/688 439/607.05 |
| 9,240,638 | B2 | 1/2016 | Peloza | |
| 9,356,401 | B1 * | 5/2016 | Horning | H01R 13/6585 |
| 9,373,917 | B2 * | 6/2016 | Sypolt | H01R 13/6585 |
| 2015/0118908 | A1 * | 4/2015 | Pan | H01R 13/6474 439/607.1 |
| 2016/0141807 | A1 * | 5/2016 | Gailus | H01R 12/7076 439/607.05 |

* cited by examiner

*Primary Examiner* — Hae Moon Hyeon

(57) ABSTRACT

An electrical connector includes a housing, signal pods, and ground shields. The housing has a base that is electrically conductive. The base has chambers and ground slots extending therethrough. The chambers are defined by chamber walls that separate the chambers from the ground slots. The signal pods, which each include a dielectric body holding a pair of signal contacts, are received in the chambers. The dielectric body engages the chamber walls and electrically insulates the signal contacts from the base. The ground shields are received in the ground slots. Each ground shield surrounds an associated signal pod on at least two sides to provide electrical shielding for the signal contacts in the signal pod from other signal contacts.

20 Claims, 6 Drawing Sheets

ELECTRICAL CONNECTOR HAVING COMMONED GROUND SHIELDS

BACKGROUND OF THE INVENTION

The subject matter herein relates generally to an electrical connector having signal contacts and associated ground shields.

Some electrical connector systems utilize receptacle and header connectors to interconnect two circuit boards, such as a motherboard and daughtercard. When the connectors are mated, the circuit boards may be arranged parallel to one another. Such connector systems can be complex and difficult to manufacture. The connectors can have ground shields that are designed to shield signal contacts from other signal contacts within the connectors. The ground shields may be electrically commoned at the circuit boards, but a lack of commoning of the ground shields in a region between the circuit boards reduces the shielding effectiveness and therefore inhibits electrical performance of the connector system. For example, gaps between adjacent ground shields within the connectors may allow electrical resonance that interferes with signal transmission, thus reducing signal integrity. Such electrical interference is typically exacerbated by increasing signal transmission speeds.

A need remains for a connector having enhanced ground shielding that improves electrical performance.

BRIEF DESCRIPTION OF THE INVENTION

In one embodiment, an electrical connector is provided that includes a housing, signal pods, and ground shields. The housing has a base extending between a front side and a rear side that faces a circuit board. The base is electrically conductive. The base has chambers and ground slots extending therethrough between the front and rear sides. The chambers are defined by chamber walls that separate the chambers from the ground slots. The signal pods are received in the chambers of the base. Each signal pod has a dielectric body holding a pair of signal contacts. The dielectric body engages the chamber walls and electrically insulates the signal contacts from the electrically conductive base. The signal contacts have mating segments protruding from the dielectric body and extending from the front side of the base. The signal contacts further have tails protruding from the dielectric body and extending from the rear side of the base for termination to the circuit board. The ground shields are received in the ground slots of the base. Each ground shield surrounds an associated signal pod on at least two sides of the signal pod to provide electrical shielding for the pair of signal contacts in the signal pod from other pairs of signal contacts.

In another embodiment, an electrical connector is provided that includes a housing, signal pods, and ground shields. The housing has a base extending between a front side and a rear side that faces a circuit board. The base is electrically conductive. The base has chambers and ground slots extending therethrough between the front and rear sides. The chambers are defined by chamber walls that separate the chambers from the ground slots. The ground slots are C-shaped. Each ground slot surrounds a corresponding chamber along three sides thereof. The signal pods are received in the chambers of the base. Each signal pod has a dielectric body holding a pair of signal contacts. The dielectric body engages the chamber walls and electrically insulates the signal contacts from the electrically conductive base. The signal contacts have mating segments protruding from the dielectric body and extending from the front side of the base. The signal contacts further have tails protruding from the dielectric body and extending from the rear side of the base for termination to the circuit board. The ground shields are received in the ground slots of the base. The ground shields are C-shaped. The ground shield in a corresponding ground slot surrounds an associated signal pod on three sides of the signal pod to provide electrical shielding for the pair of signal contacts in the signal pod from other pairs of signal contacts.

In yet another embodiment, an electrical connector is provided that includes a housing, signal pods, and ground shields. The housing extends between a mating end and a mounting end. The housing includes a base that defines the mounting end and shroud walls that extend from the base to the mating end. The base and the shroud walls define a cavity configured to receive a mating connector therein. The base is electrically conductive. The base has chambers and ground slots extending therethrough. The chambers are defined by chamber walls that separate the chambers from the ground slots. The signal pods are received in the chambers of the base. Each signal pod has a dielectric body holding a pair of signal contacts. The dielectric body engages the chamber walls and electrically insulates the signal contacts from the electrically conductive base. The signal contacts have mating segments protruding from the dielectric body and extending into the cavity to mate with signal contacts of the mating connector. The signal contacts further have tails protruding from the dielectric body and extending from the mounting end of the housing for termination to a circuit board. The ground shields are received in the ground slots of the base. Each ground shield surrounds an associated signal pod on at least two sides of the signal pod to provide electrical shielding for the pair of signal contacts in the signal pod from other pairs of signal contacts. The ground shields extend into the cavity to shield the mating segments of the signal contacts and mate with ground contacts of the mating connector.

DETAILED DESCRIPTION OF THE INVENTION

Figure 1:
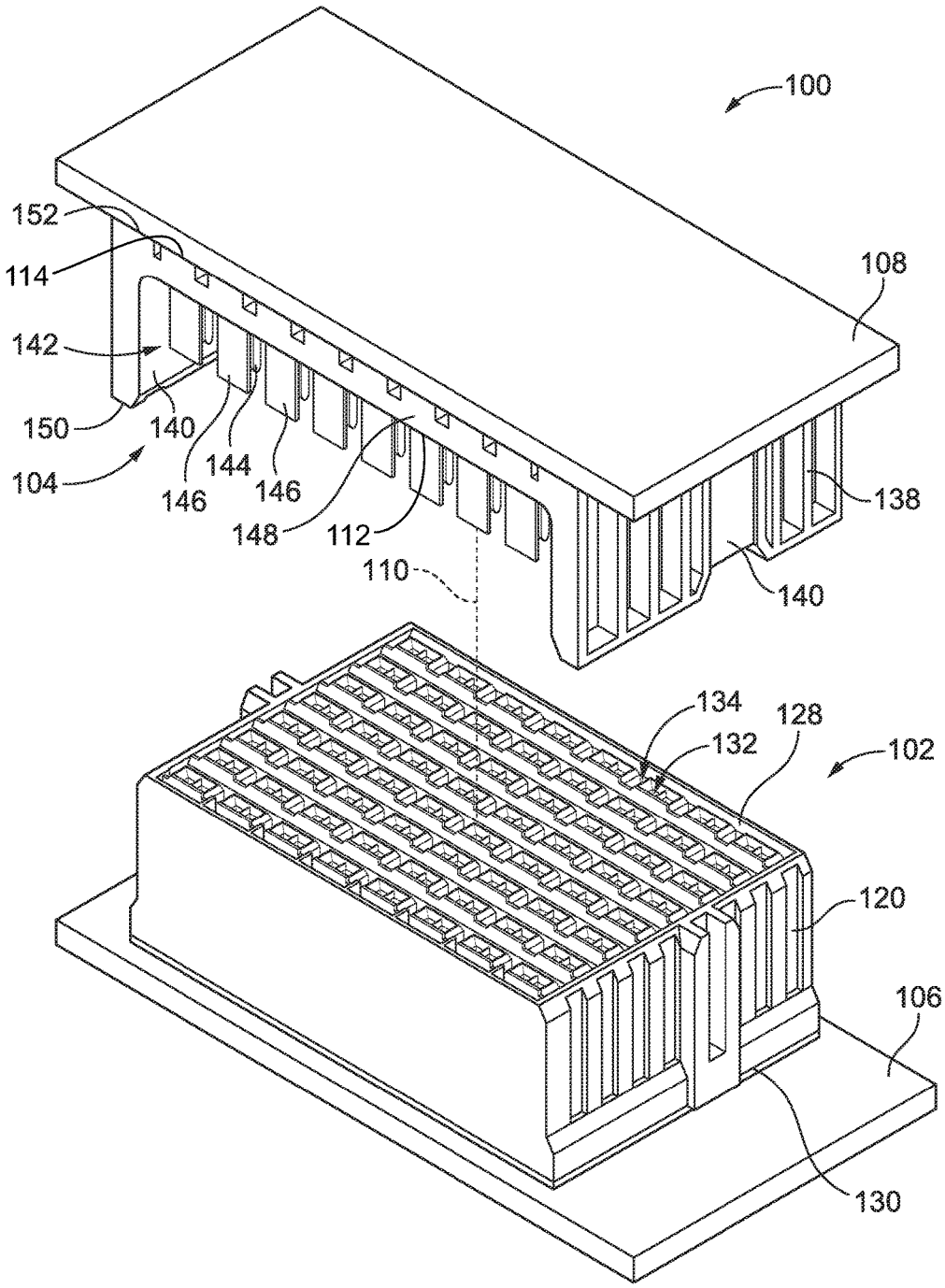
FIG. 1 is a perspective view of a connector assembly illustrating a receptacle connector and a header connector poised for mating according to an embodiment.

FIG. 1 is a perspective view of a connector assembly 100 illustrating a receptacle connector 102 and a header connector 104 poised for mating according to an embodiment. The receptacle and header connectors 102, 104 may be directly mated together along a mating axis 110 to provide a signal transmission path. In an embodiment, the receptacle connector 102 and header connector 104 are provided in a mezzanine arrangement between circuit boards. For example, the receptacle connector 102 is mounted to and electrically connected to a first circuit board 106, and the header connector 104 is mounted to and electrically connected to a second circuit board 108. The receptacle and header connectors 102, 104 are utilized to electrically connect the circuit boards 106, 108 to one another at a separable mating interface.

In an exemplary embodiment, the circuit boards 106, 108 are oriented parallel to one another and spaced apart from one another with the connectors 102, 104 therebetween. The circuit boards 106, 108 and connectors 102, 104 define a mezzanine arrangement where the circuit boards 106, 108 and connectors 102, 104 are stacked. The circuit boards 106, 108 may be oriented horizontally with the connectors 102, 104 defining vertical connectors between the horizontal circuit boards 106, 108. The signal contacts of the connectors 102, 104 pass in-line or linearly therethrough in a vertical direction. Other orientations of the circuit boards 106, 108 are possible in alternative embodiments. For example, one or both of the connectors 102, 104 may be a right angle connector instead of an in-line connector. In another embodiment, one or both of the connectors 102, 104 may be cable-mounted to an electrical cable instead of mounted to a circuit board.

The receptacle connector 102 includes a receptacle housing 120 that holds a plurality of receptacle signal contacts (not shown). The receptacle signal contacts are electrically shielded by receptacle ground contacts (not shown). The receptacle housing 120 extends between a mating end 128 and a mounting end 130. In the illustrated embodiment, the mounting end 130 is substantially parallel to the mating end 128. The receptacle housing 120 includes a plurality of signal contact openings 132 and a plurality of ground contact openings 134 at the mating end 128. The receptacle signal contacts are disposed in the corresponding signal contact openings 132, and the receptacle ground contacts are disposed in the ground contact openings 134. The signal contact openings 132 receive corresponding header signal contacts 144 therein when the receptacle and header connectors 102, 104 are mated to allow the header signal contacts 144 to mate with the receptacle signal contacts. The ground contact openings 134 receive header ground shields 146 therein when the receptacle and header connectors 102, 104 are mated to allow the header ground shields 146 to mate with the receptacle ground contacts.

The receptacle housing 120 may be manufactured from a dielectric material, such as a plastic material, that provides electrical insulation between the signal contact openings 132 and the ground contact openings 134. Therefore, the receptacle housing 120 may electrically insulate the receptacle signal contacts and the header signal contacts 144 in the signal contact openings 132 from the receptacle ground contacts and the header ground shields 146 in the ground contact openings 134. The receptacle signal contacts protrude beyond the mounting end 130 of the receptacle housing 120 for electrically terminating (for example, electrically connecting in direct mechanical engagement) to the first circuit board 106.

The header connector 104 includes a header housing 138 extending between a mating end 150 and an opposite mounting end 152 that is mounted to the second circuit board 108. Optionally, the mounting end 152 may be substantially parallel to the mating end 150. The header housing 138 includes a base wall or housing base 148, which is referred to herein as base 148. The base 148 has a front side 112 and an opposite rear side 114. The rear side 114 of the base 148 may define the mounting end 152 of the header housing 138. The rear side 114 faces the circuit board 108. The header signal contacts 144 and the header ground shields 146 are held by the base 148. The signal contacts 144 and ground shields 146 extend from the base 148 to be received in the respective signal contact openings 132 and ground contact openings 134 of the receptacle housing 120 when the connectors 102, 104 are mated. The header signal contacts 144 and the header ground shields 146 have terminating ends that extend through the base wall 148 and are mounted to the circuit board 108.

In one or more embodiments described herein, the header housing 138 is fully or at least partially electrically conductive. For example, the base 148 is electrically conductive due to being composed entirely of one or more metals (for example, a die-cast metal), being composed of a non-conductive core material that is coated in a layer of metal (for example, a conductor-plated polymer), being composed of a lossy material having metal particles embedded in a non-conductive material, being composed of a conductive polymer material, being composed of a carbon-filled polymer material, or the like. The electrically conductive base 148 engages the header ground shields 146 held in the base 148 to electrically common the header ground shields 146 with one another. The header signal contacts 144 are electrically insulated from the electrically conductive base 148 to avoid potential short-circuits. Electrically commoning the ground shields with one another along the base 148 of the housing 138 may improve the shielding effectiveness and, as a result, may provide enhanced shielding effectiveness and signal performance relative to known connector systems.

In an embodiment, the header housing 138 also includes shroud walls 140 that extend from the base 148 and define the mating end 150 of the housing 138. The shroud walls 140 and the base 148 define a cavity 142. The header signal contacts 144 and ground shields 146 extend from the base 148 into the cavity 142. The receptacle connector 102 is received in the cavity 142 through the mating end 150. The receptacle housing 120 may engage the shroud walls 140 to guide the receptacle connector 102 into the cavity 142.

Figure 2:
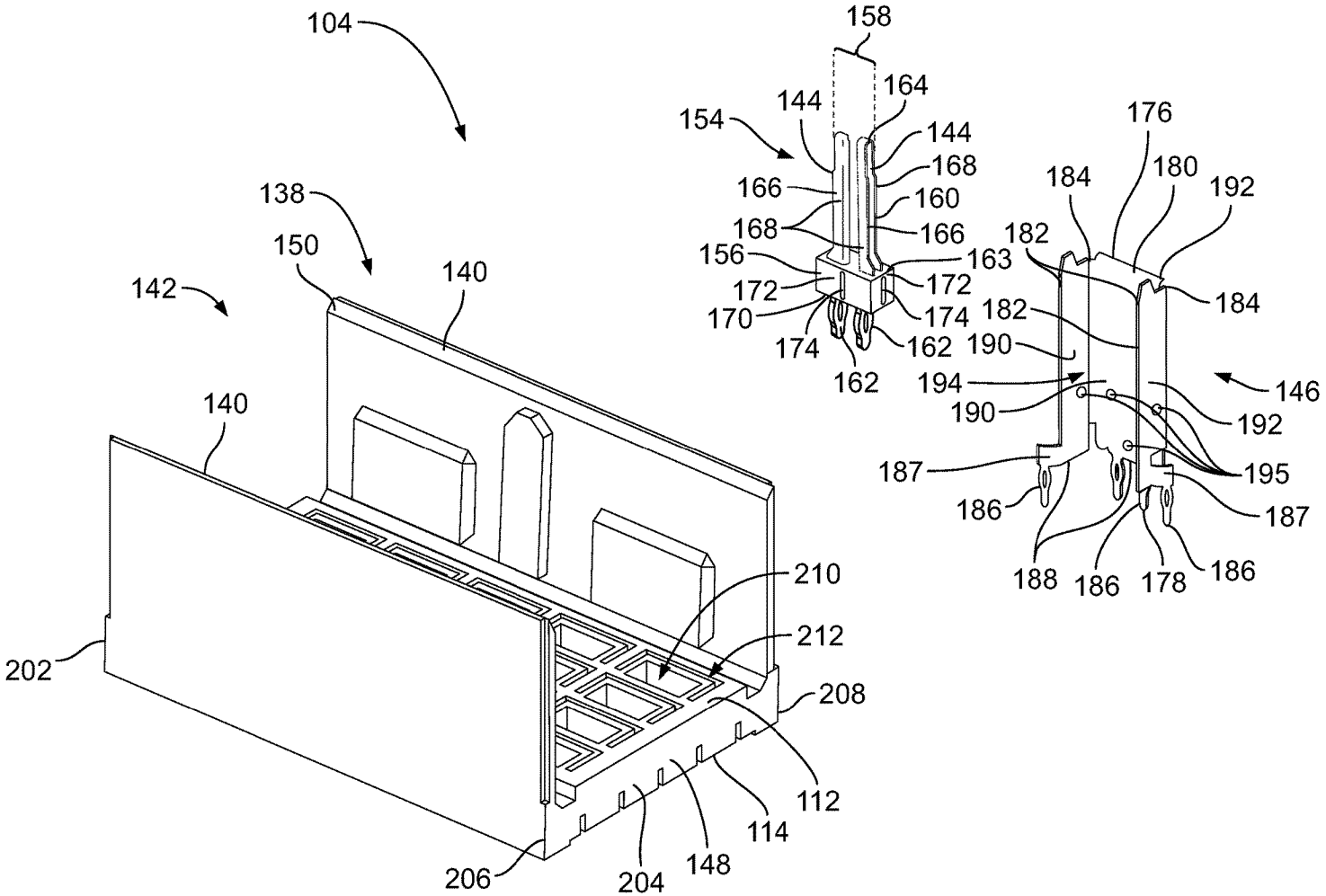
FIG. 2 is an exploded perspective view of the header connector according to an embodiment.

FIG. 2 is an exploded perspective view of the header connector 104 according to an embodiment. The header connector 104 includes the header housing 138 (referred to herein as housing 138), multiple signal pods 154 that hold the header signal contacts 144 (referred to herein as signal contacts 144), and multiple header ground shields 146 (referred to herein as ground shields 146). Only one signal pod 154 and one ground shield 146 are shown in FIG. 2. The illustrated signal pod 154 and ground shield 146 may represent the shapes and features of the other respective signal pods 154 and ground shields 146.

The signal pod 154 includes a dielectric body 156 holding a pair 158 of signal contacts 144. The two signal contacts 144 are held apart from each other such that the signal contacts 144 do not engage one another. The pair 158 of signal contacts 144 may be used to convey differential signals. The signal contacts 144 may extend generally parallel to each other. The signal contacts 144 are composed of a conductive material, such as one or more metals like copper, aluminum, silver, or the like. The signal contacts 144 may be stamped and formed. The signal contacts 144 each have a mating segment 160, a tail 162, and an intermediate segment (not shown) between the mating segment 160 and the tail 162.

The mating segment 160 extends from a front end 163 of the dielectric body 156 to a distal end 164 of the signal contact 144. The mating segment 160 is configured to engage a corresponding receptacle signal contact (not shown) of the receptacle connector 102 (shown in FIG. 1) when the connectors 102, 104 are mated. The mating segment 160 in the illustrated embodiment is a pin or blade, but may have another shape in an alternative embodiment, such as a socket. Each signal contact 144 has two broad sides 166 and two edge sides 168 that extend between the broad sides 166. The broad sides 166 are wider than the edge sides 168. In the illustrated embodiment, the signal contacts 144 are broadside-coupled in the dielectric body 156, such that one of the broad sides 166 of one signal contact 144 faces an opposing one of the broad sides 166 of the other signal contact 144 in the pair 158. Alternatively, the signal contacts 144 may be edgeside-coupled or may have another orientation in the signal pod 154.

The tails 162 of the signal contacts 144 are configured to terminate to the circuit board 108 (shown in FIG. 1) to electrically connect the signal contacts 144 to the circuit board 108. Each tail 162 protrudes from a rear end 170 of the dielectric body 156. In the illustrated embodiment, the tails 162 are compliant pins, such as eye-of-the-needle pins, that are configured to be through-hole mounted to the circuit board 108. For example, the compliant pin tails 162 may be received in corresponding vias or through-holes (not shown) of the circuit board 108. In another embodiment, the tails 162 may be solder tails configured to be surface-mounted to the circuit board 108, or the like.

The dielectric body 156 is composed of a dielectric material, such as one or more plastics. The dielectric body 156 surrounds and encases the intermediate segments (not shown) of the signal contacts 144 to hold the signal contacts 144 in fixed positions relative to the dielectric body 156. The dielectric body 156 may be formed in situ on the signal contacts 144 via overmolding. Alternatively, the dielectric body 156 may be formed prior to engaging the signal contacts 144 such that the dielectric body 156 defines two openings that each receives one of the signal contacts 144 therein during an assembly process. The dielectric body 156 extends between the front end 163 and the rear end 170. The shape of the dielectric body 156 is optionally a rectangular prism or parallelepiped, with four sides 172 extending between the front and rear ends 163, 170, but the dielectric body 156 may have other shapes in alternative embodiments. In an embodiment, the dielectric body 156 includes one or more crush ribs 174 along the sides 172. The crush ribs 174 are configured to provide an interference fit with the base 148 of the housing 138 when the signal pod 154 is loaded in the base 148.

The ground shield 146 extends between a mating end 176 and a terminating end 178. In the illustrated embodiment, the ground shield 146 has a center wall 180 and two side walls 182 that extend from respective edges 184 of the center wall 180. The center wall 180 and the side walls 182 are generally planar. The side walls 182 may extend generally parallel to each other in a common direction from the center wall 180. Thus, the ground shield 146 has a C-shaped cross-section defined by a plane perpendicular to the center wall 180 and the two side walls 182. Optionally, the side walls 182 may be oriented at approximately right angles relative to the plane of the center wall 180. The ground shield 146 may be stamped and formed from a sheet of metal. For example, the center wall 180 may be formed integral to the side walls 182, such that the side walls 182 are bent out of plane from the center wall 180. The ground shield 146 includes contact tails 186 extending from rear edges 188 of the center wall 180 and side walls 182 to the terminating end 178. The contact tails 186 in the illustrated embodiment are compliant pins configured to be through-hole mounted to the circuit board 108 (shown in FIG. 1) to provide an electrical grounding path between the ground shield 146 and the circuit board 108. In the illustrated embodiment, the ground shield 146 includes a tab 187 extending from each of the side walls 182 proximate to the rear edges 188. One contact tail 186 extends from each of the tabs 187. The tabs 187 may be used to match the footprint of the ground shield 146 to a designated arrangement of vias or through-holes in the circuit board 108. In an alternative embodiment, instead of compliant pins, the contact tails 186 may be solder tails configured to be surface-mounted to the circuit board 108 or another type of mounting interface. In the illustrated embodiment, the center wall 180 and the side walls 182 extend from the respective rear edges 188 to the mating end 176 of the ground shield 146. In an alternative embodiment, the ground shield 146 may include one or more projections, such as contact beams, extending from the center wall 180 and/or side walls 182 and defining the mating end 176 of the ground shield 146.

The center wall 180 and the side walls 182 of the ground shield 146 have interior sides 190 and exterior sides 192. The interior sides 190 of the walls 180, 182 define a channel 194 configured to receive a corresponding signal pod 154 therein. The exterior sides 192 face away from the channel 194. The ground shield 146 in the illustrated embodiment includes multiple protrusions 195 along the center wall 180 and the side walls 182. The protrusions 195 may be bumps, bulges, or the like that extend out from the plane of the respective walls 180, 182. Some protrusions 195 are disposed along the interior side 190 of a respective wall 180, 182, and other protrusions 195 are disposed along the exterior side 192. The protrusions 195 are located at different heights (or lengths) along the ground shield 146 between the mating and terminating ends 176, 178, although all protrusions 195 are more proximate to, the rear edges 188 of the walls 180, 182 than to the mating end 176.

The housing 138 is oriented in the illustrated embodiment such that the mating end 150 faces upward. The base 148 extends a length between opposite first and second ends 202, 204. The base 148 extends a width between opposite first and second edge sides 206, 208. In the illustrated embodiment, the housing 138 includes two shroud walls 140 that extend from the edge sides 206, 208. The cavity 142 defined by the shroud walls 140 and the base 148 is open along the first and second ends 202, 204 of the base 148. In an alternative embodiment, the housing 138 may include additional shroud walls extending along the ends 202, 204 to fully-enclose a perimeter of the cavity 142.

The base 148 defines chambers 210 and ground slots 212 extending through the base 148. The chambers 210 are sized and shaped to each receive a signal pod 154 therein. The ground slots 212 are sized and shaped to each receive a ground shield 146 therein. The chambers 210 and the ground slots 212 extend fully through the base 148 between the front and rear sides 112, 114.

Figure 3:
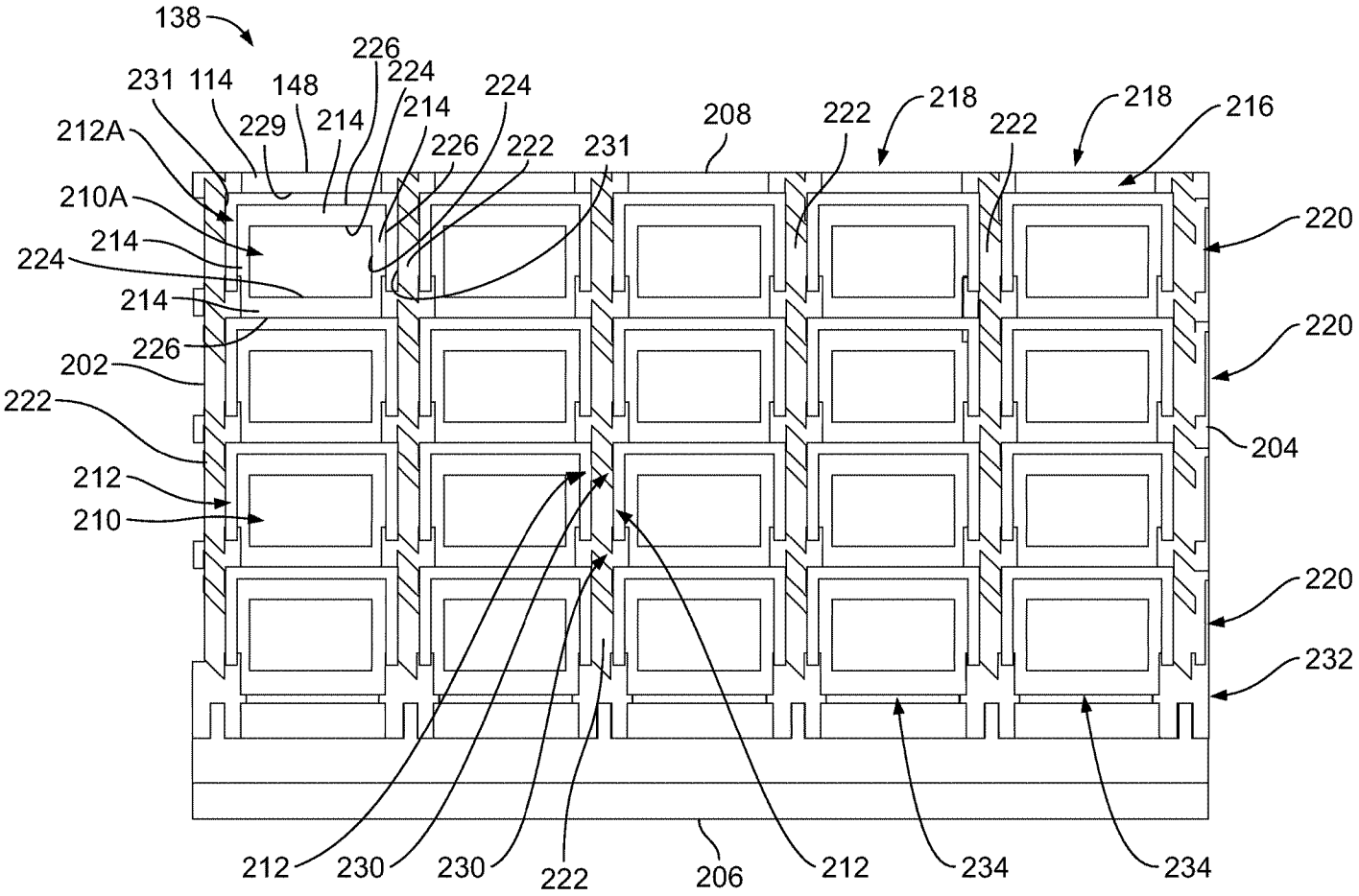
FIG. 3 shows a rear side of a housing base of the header connector according to an embodiment.

Reference is made to FIG. 3, which shows the rear side 114 of the base 148 of the housing 138 according to an embodiment. The chambers 210 and the ground slots 212 are arranged in an array 216 of multiple columns 218 extending along the width of the base 148 between the first and second edge sides 206, 208 and multiple rows 220 extending along the length of the base 148 between the first and second ends 202, 204. Adjacent columns 218 are separated from each other by divider walls 222 that extend between the first and second edge sides 206, 208. Optionally, each divider wall 222 extends the entire width of the base 148. Each ground slot 212 is associated with a corresponding one of the chambers 210. For example, the ground slot 212A is associated with the chamber 210A. The ground slot 212 is separated from the associated chamber 210 by chamber walls 214 of the base 148. The chamber walls 214 define the chambers 210 and at least partially define the ground slots 212. For example, the chamber walls 214 include interior sides 224 and opposite, exterior sides 226. Each chamber 210 has a rectangular shape defined by the interior sides 224 of four chamber walls 214.

The ground slots 212 are defined by inner surfaces 229 of the base 148. The inner surfaces 229 include the exterior sides 226 of the chamber walls 214 and sides 231 of the divider walls 222. For example, the exterior sides 226 of the chamber walls 214 define a portion of each ground slot 212, and sides 231 of two divider walls 222 define the remaining portions of each ground slot 212 (that are not defined by the exterior sides 226). In the illustrated embodiment, the ground slots 212 are C-shaped to accommodate the ground shields 146 (shown in FIG. 2) therein. The ground slot 212 surrounds the associated chamber 210 on three sides thereof. The chamber walls 214 extend fully through the thickness of the base 148 between the front side 112 (shown in FIG. 2) and the rear side 114 and do not include any openings, such that the ground slots 212 are not open to the chambers 210.

In an embodiment, the base 148 further includes grooves 230 defined in the divider walls 222 along the rear side 114 of the base 148. The grooves 230 are open to the ground slots 212 and extend laterally therefrom at an oblique angle relative to the divider walls 222. The grooves 230 are configured to receive the tabs 187 of the ground shields 146 therein.

In an embodiment, the base 148 further defines a row 232 of orphan slots 234 between the rows 220 and the first edge side 206. Each of the orphan slots 234 is generally linear and oriented parallel to the first edge side 206 of the base 148. The orphan slots 234 are configured to receive orphan shields 240 (shown in FIG. 4) therein. The orphan shields 240 may resemble the center walls 180 (shown in FIG. 2) of the ground shields 146 (FIG. 2) without the side walls 182. The orphan shields 240 in the orphan slots 234 provide shielding for the signal contacts 144 (FIG. 2) disposed in the chambers 210 of the row 220 most proximate to the first edge side 206 of the base 148.

The base 148 of the housing 138 is electrically conductive. In an embodiment, the base 148 may be composed entirely of one or more metals. For example, the base 148 may be a solid (or hollow) metal that is formed via die-casting or a different molding process. In another embodiment, the base 148 may be composed of a non-conductive core material, such as one or more plastics, that is coated in a layer of one or more metals. For example, the metal layer that coats the non-conductive core material may be applied via electro-plating, physical vapor deposition (PVD), dipping, spraying, painting, or the like. In yet another embodiment the base 148 may be composed of an electrically lossy material that includes metal particles (for example, flakes, powder, shavings, or the like) embedded and dispersed in a non-conductive material, such as one or more plastics. The base 148 may be molded into shape using the lossy material to provide the electrical conductivity. In another embodiment, the base 148 may be composed of a conductive polymer, which is an organic polymer that conducts electricity.

The portion of the base 148 that defines the chambers 210 and ground slot 212 is electrically conductive. For example, the chamber walls 214 are electrically conductive. Optionally, the entire structure of the base 148 is electrically conductive, or alternatively one or more end portions of the base 148 are not electrically conductive. The shroud walls 140 (shown in FIG. 2) of the housing 138 may be electrically conductive. For example, the housing 138 may have a unitary, one-piece structure that is entirely electrically conductive. Alternatively, the shroud walls 140 are not electrically conductive.

Figure 4:
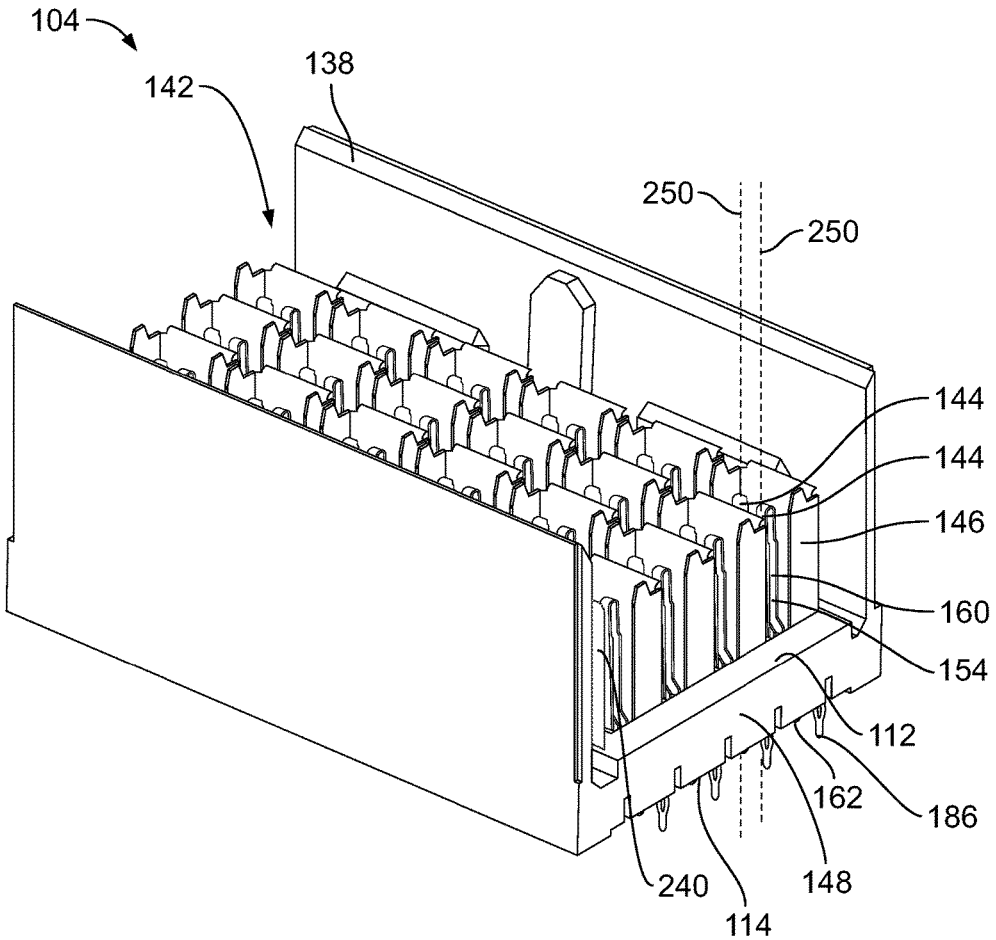
FIG. 4 is a perspective view of the header connector according to an embodiment.

FIG. 4 is a perspective view of the header connector 104 according to an embodiment. In FIG. 4, the signal pods 154 are loaded in the chambers 210 (shown in FIG. 3) of the base 148 of the housing 138, and the ground shields 146 are loaded in the ground slots 212 (FIG. 3). FIG. 4 also shows a portion of one orphan shield 240 held in an orphan slot 234 (FIG. 3). The mating segments 160 of the signal contacts 144 extend from the front side 112 of the base 148 into the cavity 142. The tails 162 of the signal contacts 144 extend from the rear side 114 of the base for termination to the circuit board 108 (shown in FIG. 1). The signal contacts 144 may extend along contact axes 250 through the base 148. In an embodiment, the front side 112 of the base 148 is parallel to the rear side 114, and the contact axes 250 are perpendicular to the planes defined by the front and rear sides 112, 114. The ground shields 146 also extend from the front side 112 of the base 148 into the cavity 142 to surround and electrically shield the mating segments 160 of the signal contacts 144. The compliant pins 186 of the ground shields 146 extend from the rear side 114 of the base 148 for termination to the circuit board 108.

Figure 5:
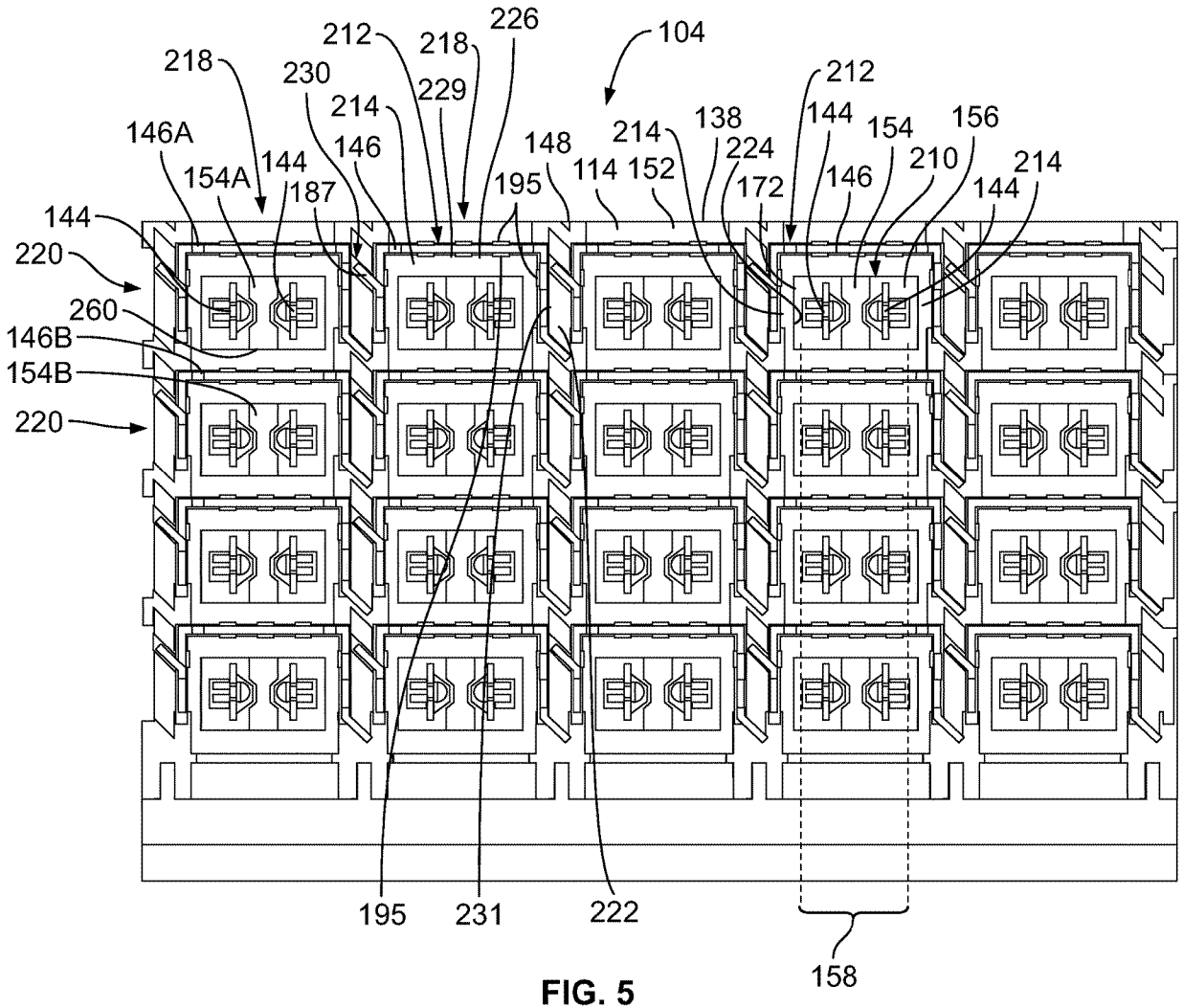
FIG. 5 shows the header connector along a mounting end of the housing of the header connector according to an embodiment.

FIG. 5 shows the header connector 104 along the mounting end 152 of the housing 138 according to an embodiment. The rear side 114 of the base 148 defines the mounting end 152. The signal pods 154 are disposed in the chambers 210, and the ground shields 146 are disposed in the ground slots 212. As described above, the base 148 is electrically conductive. The dielectric body 156 of each signal pod 154 engages the chamber walls 214 to electrically insulate the signal contacts 144 from the conductive chamber walls 214. Thus, the signal contacts 144 in each pair 158 are spaced apart from each other and from the base 148 of the housing 138 via the dielectric body 156. The signal pods 154 optionally may be held in the chambers 210 via an interference fit. For example, the crush ribs 174 (shown in FIG. 2) and/or the sides 172 of the dielectric body 156 may engage the interior sides 224 of the chamber walls 214. The dielectric body 156 may be at least partially compressed within the chamber 210. In other embodiments, the dielectric body 156 and/or the chamber walls 214 may include stop features or other projections that secure the dielectric body 156 within the chamber 210 to fix the signal contacts 144 relative to the base 148. In another embodiment, the dielectric body 156 may be insert molded into the base 148 of the housing 138.

The ground shields 146 are disposed in the ground slots 212. As shown, the tabs 187 of the ground shields 146 are disposed in the grooves 230. The ground shield 146 in a corresponding ground slot 212 engages the inner surfaces 229 (for example, the exterior sides 226 of the chamber walls 214 and/or the sides 231 of the divider walls 222) of the base 148 that define the ground slot 212 to electrically connect the ground shield 146 to the electrically conductive base 148. For example, the protrusions 195 on the ground shields 146 engage the inner surfaces 229 at various locations. Although not shown in FIG. 5, the ground shields 146 in an embodiment may engage the inner surfaces 229 of the base 148 at multiple different contact locations along the height of the base 148 between the rear side 114 and the front side 112 (shown in FIG. 2). For example, one protrusion 195 on a ground shield 146 may engage an inner surface 229 at a first contact location proximate to the rear side 114, and another protrusion 195 on the same ground shield 146 may engage the same or a different inner surface 229 at a different, second contact location that is more proximate to the front side 112 (relative to the proximity of the first contact location to the front side 112).

The ground shields 146 in the ground slots 212 are spaced apart from one another such that the ground shields 146 optionally do not engage each other directly. The ground shields 146 engage the electrically conductive base 148, and are electrically commoned to one another indirectly via the base 148. For example, electrical current is allowed to flow along the base 148, including along the chamber walls 214 and divider walls 222 that engage the ground shields 146. In an embodiment, since the ground shields 146 engage the inner surfaces 229 of the base 148 at different contact locations along the height of the base 148, the ground shields 146 are electrically commoned along the height of the base 148 and not merely at a single grounding plane, which may improve the electrical performance of the header connector 104 by reducing harmful interference and resonance.

The ground shields 146 are positioned between the signal pods 154 to provide electrical shielding between adjacent pairs 158 of signal contacts 144. Each ground shield 146 is associated with a corresponding one of the signal pods 154. The ground shields 146 surround the associated signal pods 154 on at least two sides thereof to provide electrical shielding for the pair 158 of signal contacts 144 in the signal pod 154 from other pairs 158 of signal contacts 144. In the illustrated embodiment, the ground shields 146 are C-shaped and surround the associated signal pods 154 on three sides thereof. An adjacent ground shield 146 associated with another signal pod 154 provides shielding along the open, fourth side of the signal pod 154 such that each of the pairs 158 of signal contacts 144 is shielded from each adjacent pair 158 in the same column 218 and each adjacent pair 158 in the same row 220. For example, a first ground shield 146A surrounds an associated first signal pod 154A on three sides. A second ground shield 146B that is adjacent to the first ground shield 146A in the same column 218 provides shielding for the first signal pod 154A along an open, fourth side 260 of the first signal pod 154A. The second ground shield 146B is associated with a second signal pod 154B and surrounds the second signal pod 154B on three sides thereof. Although not shown, the shape and/or size of the ground shields 146 may change along different portions thereof for impedance control or control of other electrical characteristics.

Figure 6:
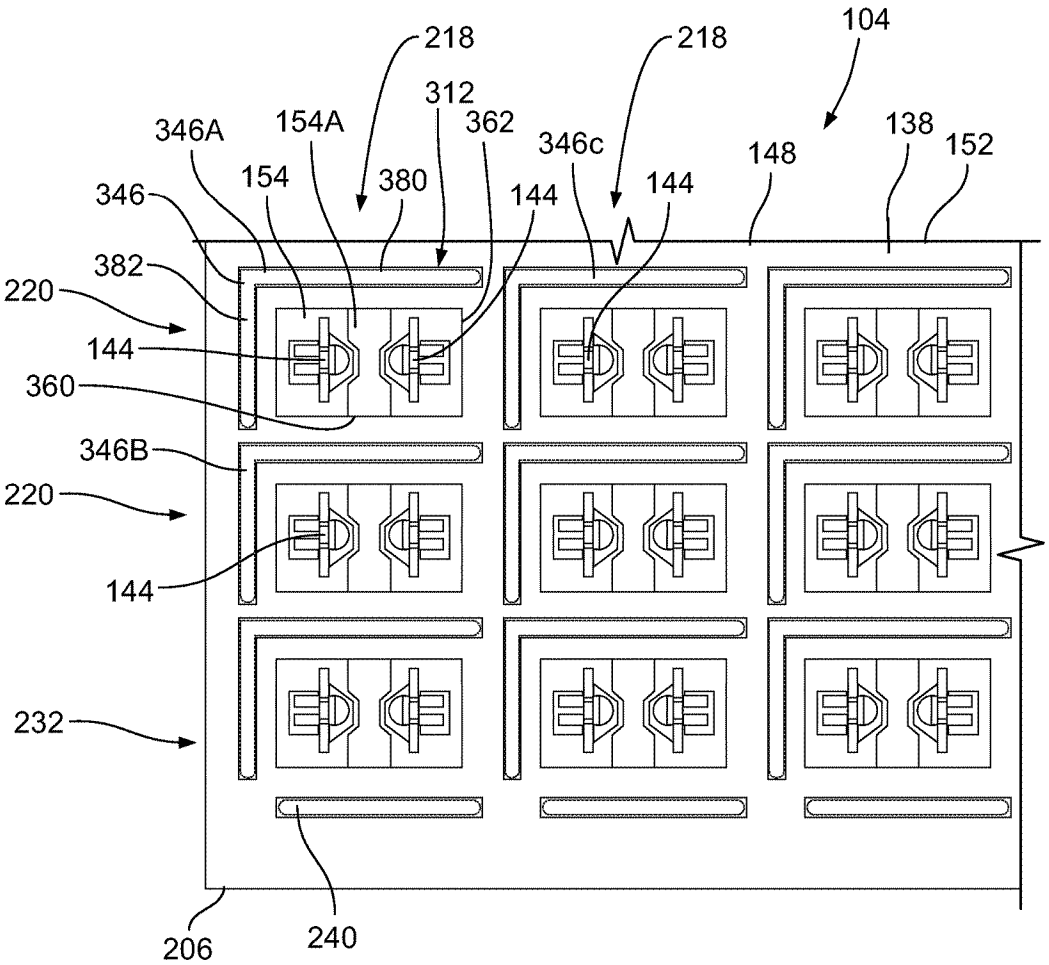
FIG. 6 shows a portion of the header connector along the mounting end of the housing according to an alternative embodiment.

FIG. 6 shows a portion of the header connector 104 along the mounting end 152 of the housing 138 according to an alternative embodiment. In the illustrated embodiment, the ground shields 346 are L-shaped instead of C-shaped, having a center wall 380 and one side wall 382 extending from the center wall 380. The ground shields 346 are held in L-shaped ground slots 312 that accommodate the ground shields 346. Each ground shield 346 surrounds an associated signal pod 154 on two sides thereof to provide electrical shielding for the signal contacts 144 in the signal pod 154 from other signal contacts 144. For example, a first ground shield 346A surrounds a first signal pod 154A on two sides. A second ground shield 346B adjacent to the first ground shield 346A in the same column 218 provides shielding for the first signal pod 154A along an open, third side 360 of the first signal pod 154A. A third ground shield 346C adjacent to the first ground shield 346A in the same row 220 provides shielding for the first signal pod 154A along an open, fourth side 362 of the first signal pod 154A such that the first signal pod 154A is shielded on all four sides. The electrical connector 104 further includes orphan shields 240 arranged in a row 232 between the first edge side 206 of the housing 138 and the row 220 of signal pods 154 most proximate to the first edge side 206 to provide shielding along the open, third sides 360 of the signal pods 154. Although not shown in the portion of the connector 104 illustrated in FIG. 6, the connector 104 may further include orphan shields arranged in a column that provides shielding along the open, fourth sides 362 of the signal pods 154 in the column 218 most proximate to the second end 204 (shown in FIG. 3) of the housing 138. Therefore, every signal pod 154 may be shielded on all four sides. The base 148 of the housing 138 is electrically conductive and engages each of the ground shields 346 to electrically common the ground shields 346 along a thickness of the base 148. More or less shield walls may be provided in alternative embodiments. The walls may be bent or angled rather than being planar.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a base extending between a front side and a rear side, the base being electrically conductive, the base having chambers and ground slots extending therethrough between the front and rear sides, the chambers being defined by chamber walls that separate the chambers from the ground slots;

signal pods disposed in the chambers of the base, each signal pod having a dielectric body holding a pair of signal contacts, the dielectric body extending through the corresponding chamber and engaging interior sides of the chamber walls, the dielectric body electrically insulating the signal contacts from the electrically conductive base, the signal contacts having mating segments protruding from the dielectric body and extending from the front side of the base, the signal contacts further having tails protruding from the dielectric body and extending from the rear side of the base; and ground shields received in the ground slots of the base, each ground shield surrounding an associated signal pod on at least two sides of the signal pod to provide electrical shielding for the pair of signal contacts in the signal pod from other pairs of signal contacts.

2. The electrical connector of claim 1, wherein the housing extends between a mating end and a mounting end that is defined by the rear side of the base, the housing including shroud walls extending from the front side of the base to the mating end, the front side of the base and the shroud walls defining a cavity configured to receive a mating connector therein, the mating segments of the signal contacts and the ground shields extending into the cavity to mate with respective signal and ground contacts of the mating connector.

3. The electrical connector of claim 1, wherein the ground shields are C-shaped, each ground shield surrounding the associated signal pod on three sides thereof.

4. The electrical connector of claim 3, wherein the ground slots are C-shaped to accommodate the ground shields, each ground slot surrounding a corresponding chamber on three sides thereof.

5. The electrical connector of claim 1, wherein each ground slot is defined by inner surfaces of the base, the ground shield in a corresponding ground slot engages one or more of the inner surfaces of the base at multiple contact locations that are spaced apart along a height of the base between the front side and the rear side to electrically connect the ground shield to the base.

6. The electrical connector of claim 1, wherein the chambers and ground slots in the base are arranged in an array, the ground shields in the ground slots of the array being spaced apart from one another, the ground shields engaging the base and being electrically connected to one another via the electrically conductive base.

7. The electrical connector of claim 1, wherein the signal contacts each include two broad sides and two edge sides that extend between the two broad sides, the dielectric body of each signal pod holding the pair of signal contacts such that the signal contacts are spaced apart from each other and one broad side of one of the signal contacts faces an opposing broad side of the other signal contact.

8. The electrical connector of claim 1, wherein the base of the housing is at least one of composed entirely of one or more metals, composed of a non-conductive core material coated in a layer of one or more metals, composed of a lossy material having metal particles embedded in a non-conductive material, composed of a conductive polymer, or composed of a carbon-filled polymer.

9. The electrical connector of claim 1, wherein the ground slots in the base are arranged in an array having multiple columns of ground slots separated by divider walls of the base, the divider walls defining grooves along the rear side of the base that extend laterally from the ground slots, the ground shields including tabs that are disposed in the grooves.

10. The electrical connector of claim 1, wherein the front side of the base is parallel to the rear side, the signal contacts extending along contact axes through the dielectric body, the contact axes being perpendicular to the front and rear sides of the base.

11. The electrical connector of claim 1, wherein the chamber walls extend fully through the base between the front and rear sides thereof.

12. The electrical connector of claim 1, wherein each of the ground shields extend a height between a mating end and a terminating end, each ground shield including at least one wall and multiple protrusions extending from the at least one wall at different locations spaced apart along the height of the ground shield, the protrusions engaging inner surfaces of the base that define the ground slots at multiple contact locations that are spaced apart along a height of the base between the front side and the rear side.

13. An electrical connector comprising:

a housing having a base extending between a front side and a rear side, the base being electrically conductive, the base having chambers and ground slots extending therethrough between the front and rear sides, the chambers being defined by chamber walls that separate the chambers from the ground slots, the ground slots being C-shaped, each ground slot surrounding a corresponding chamber along three sides thereof;

signal pods received in the chambers of the base, each signal pod having a dielectric body holding a pair of signal contacts, the dielectric body extending through the corresponding chamber and engaging interior sides of the chamber walls, the dielectric body electrically insulating the signal contacts from the electrically conductive base, the signal contacts having mating segments protruding from the dielectric body and extending from the front side of the base, the signal contacts further having tails protruding from the dielectric body and extending from the rear side of the base; and ground shields received in the ground slots of the base, the ground shields being C-shaped, the ground shield in a corresponding ground slot surrounding an associated signal pod on three sides of the signal pod to provide electrical shielding for the pair of signal contacts in the signal pod from other pairs of signal contacts.

14. The electrical connector of claim 13, wherein a first signal pod of the signal pods is surrounded on three sides by a first ground shield of the ground shields, wherein a second ground shield of the ground shields that is adjacent to the first ground shield provides shielding for the first signal pod along an open, fourth side of the first signal pod, the second ground shield surrounding a second signal pod of the signal pods on three sides of the second signal pod.

15. The electrical connector of claim 13, wherein the ground shields include a center wall and two side walls extending from opposite edges of the center wall, the center wall and side walls being planar.

16. The electrical connector of claim 13, wherein the base of the housing is at least one of composed entirely of one or more metals, composed of a non-conductive core material coated in a layer of one or more metals, composed of a lossy material having metal particles embedded in a non-conductive material, composed of a conductive polymer, or composed of a carbon-filled polymer.

17. The electrical connector of claim 13, wherein each ground slot is defined by inner surfaces of the base, the ground shield in a corresponding ground slot engages one or more of the inner surfaces at multiple contact locations along a height of the base between the front side and the rear side to electrically connect the ground shield to the base.

18. An electrical connector comprising:

a housing extending between a mating end and a mounting end, the housing including a base that defines the mounting end and shroud walls that extend from the base to the mating end, the base and the shroud walls defining a cavity configured to receive a mating connector therein, the base being electrically conductive, the base having chambers and ground slots extending therethrough, the chambers being defined by chamber walls that separate the chambers from the ground slots;

signal pods received in the chambers of the base, each signal pod having a dielectric body holding a pair of signal contacts, the dielectric body extending through the corresponding chamber and engaging interior sides of the chamber walls, the dielectric body electrically insulating the signal contacts from the electrically conductive base, the signal contacts having mating segments protruding from the dielectric body and extending into the cavity to mate with signal contacts of the mating connector, the signal contacts further having tails protruding from the dielectric body and extending from the mounting end of the housing for termination to a circuit board; and ground shields received in the ground slots of the base, each ground shield surrounding an associated signal pod on at least two sides of the signal pod to provide electrical shielding for the pair of signal contacts in the signal pod from other pairs of signal contacts, the ground shields extending into the cavity to shield the mating segments of the signal contacts and mate with ground contacts of the mating connector.

19. The electrical connector of claim 18, wherein the ground shields are C-shaped, each ground shield surrounding the associated signal pod on three sides thereof, the ground slots being C-shaped to accommodate the ground shields.

20. The electrical connector of claim 18, wherein the base extends between a front side and a rear side, and the chamber walls extend fully through the base between the front and rear sides thereof.

* * * * *